US008370974B2

(12) United States Patent
Caines

(10) Patent No.: US 8,370,974 B2
(45) Date of Patent: Feb. 12, 2013

(54) FITTED BED SHEET

(76) Inventor: Karen Caines, Arlington, MA (US)

( * ) Notice: Subject to any disclaimer, the term of this patent is extended or adjusted under 35 U.S.C. 154(b) by 0 days.

(21) Appl. No.: 13/135,951

(22) Filed: Jul. 19, 2011

(65) Prior Publication Data

US 2012/0060284 A1 Mar. 15, 2012

Related U.S. Application Data

(60) Provisional application No. 61/518,470, filed on May 6, 2011, provisional application No. 61/455,650, filed on Oct. 25, 2010, provisional application No. 61/403,306, filed on Sep. 14, 2010.

(51) Int. Cl.
*A47G 9/02* (2006.01)

(52) U.S. Cl. ..... 5/497; 5/485

(58) Field of Classification Search ..... 5/485, 486, 5/497

See application file for complete search history.

(56) References Cited

U.S. PATENT DOCUMENTS

| | | | | | |
|---|---|---|---|---|---|
| 2,679,056 | A | * | 5/1954 | Simpson | 5/485 |
| 3,868,735 | A | | 3/1975 | Ross | |
| 4,021,869 | A | | 5/1977 | Root | |
| 4,308,626 | A | * | 1/1982 | Weiss | 5/485 |
| 4,336,635 | A | | 6/1982 | Lantz | |
| 4,651,371 | A | | 3/1987 | Hahn | |
| 5,042,098 | A | * | 8/1991 | Stultz | 5/495 |
| 5,165,128 | A | | 11/1992 | Honig | |
| 5,189,744 | A | | 3/1993 | Roberts | |
| 5,442,822 | A | * | 8/1995 | Diaz | 5/497 |
| 5,465,440 | A | * | 11/1995 | Heptner | 5/497 |
| 5,509,156 | A | | 4/1996 | Smith | |
| 5,884,349 | A | * | 3/1999 | Gretsinger | 5/502 |
| 6,041,456 | A | * | 3/2000 | Pharr | 5/497 |
| 6,061,851 | A | | 5/2000 | Crowell | |
| 6,725,477 | B2 | | 4/2004 | Ciaglia | |
| 7,260,858 | B2 | * | 8/2007 | Cushing | 5/497 |
| 7,380,297 | B2 | * | 6/2008 | Bauer | 5/497 |
| 7,487,561 | B2 | | 2/2009 | Ho | |
| 2004/0200000 | A1 | | 10/2004 | Harbin et al. | |
| 2006/0168726 | A1 | | 8/2006 | Cushing | |
| 2008/0010746 | A1 | | 1/2008 | Ho | |

OTHER PUBLICATIONS

"Cuddle Toes Warm feet promise better sleep!" <http://www.solutions.com/jump.jsp?itemID=15120&itemType=PRODUCT>, Sep. 26, 2012.

"Standard & Adjustable Bed Sheets" <http://bedderbedding.net/index.cfm?fuseaction=category.display&category_ID=5>, Sep. 26, 2012.

* cited by examiner

*Primary Examiner* — Michael Trettel
(74) *Attorney, Agent, or Firm* — Robert K. Tendler

(57) ABSTRACT

A fitted top sheet is provided with a lip having an elastic member that runs side to side along at least a portion of the lip. This provides corners that grab the corners of the mattress for a form fit, while at the same time permitting movement of the sheet upwardly to accommodate an individual's toes without having to provide a so-called zone of expansion.

8 Claims, 5 Drawing Sheets

FITTED BED SHEET

RELATED APPLICATIONS

This application claims rights under 35 USC §119(e) from U.S. Application Ser. Nos. 61/518,470 filed May 6, 2011; 61/455,650 filed Oct. 25, 2010 and 61/403,306 filed Sep. 14, 2010, the contents of which are incorporated herein by reference.

FIELD OF THE INVENTION

This invention relates to bed sheets and more particularly to an easy tuck top bed sheet in which the bottom of the bed sheet is provided with a lip adapted to tuck under the end of a mattress and in which only the lip is provided with an elastic material.

BACKGROUND OF THE INVENTION

As described in U.S. Pat. Nos. 5,422,822; 4,425,365; 6,725,477; and 4,651,371 various bed linens have been provided for top bed sheets with a pocket type end portion that is adapted to fit around the end of a mattress. The purpose of these fitted bed sheets is to provide a contour sheet that does not easily slide off the mattress and remains flat and tight to the mattress.

Moreover, US Patent Application Publication Serial Nos. 2004/0200000 and 2006/0168726 describe fitted top bed sheets with a fitted end.

None of the above mentioned bed sheets are provided with any kind of elasticized material or elastic at the pocket end of the bed sheet.

However with respect to U.S. Pat. No. 5,165,128, a fitted top bed sheet is provided with a rectangular portion of fabric material having two bottom corners, with each corner cut away by three curved lines to form a junction having an angle of substantially 90°, to each of which a band of stretchable material is sewn that extends across the entire outside edge of that portion of the bed sheet, thereby to draw in the corners of the bed sheet at the foot of the bed sheet.

More importantly and as described in U.S. Pat. No. 7,380,279, a fitted bed top covering is provided with a pocket that is made of elastic material such as Spandex®, a polyurethane-polyurea copolymer surrounding the end of the mattress.

In this patent it is said that the pocket that is made of the expandable material has a pocket opening that is larger in size than the extent of the mattress foot that it encases. It is said that the purpose of this increased size opening is to create a so-called zone of expansion at the foot end of the sheet to accommodate the feet of a sleeping individual.

One of the problems with such an arrangement is that the wide opening of the pocket results in a large amount of unstretched material at the foot of the bed sheet, with the unstretched material accommodating an individual's feet. It is noted that the unstretched material creates an unsightly wrinkled sheet appearance when the bed is made up.

While the pocket is enlarged for purposes of permitting an individual's feet to extend above the mattress without sheet tension on the toes, this same amount of material which is left over from the oversized aperture of the pocket creates a messy appearance. As such the sheet is unsuitable for use in commercial establishments such as hotels and motels because of its unsightly and wrinkled appearance when the bed is made up.

While several of the above-mentioned patents have elasticized material around all edges of the pocket, this elasticized pocket, whether made of Spandex®, a polyurethane-polyurea copolymer or material sewn in the seams, provides undue pressure on a sleeping individual's toes that may interfere with sleep.

Of course, if the expanded pocket aperture size creates a non-stretched amount of material at the foot of the sheet in an effort to avoid having the top sheet compressed around the individual's toes, the messy result is not a commercially viable solution.

With respect to bed sheets that have elastic material around all edges of the bed sheet, while providing a flat unwrinkled bed sheet at the foot of the bed sheet, the amount of elasticized material prevents an individual's toes from poking the bed sheet up when the individual is sleeping.

In short, with a totally elasticized pocket for a top fitted bed sheet the individual is subjected to undesirable sheet pressure on his or her toes when the individual is sleeping.

SUMMARY OF INVENTION

Rather than providing a totally elasticized pocket at the end of a bed sheet, and rather than solving the problem of undue pressure on the individuals toes by opening up the aperture or size of an elastic pocket of such a bed sheet, in the subject invention an easy tuck bed sheet is provided with an elastic member only on a lip at foot of the sheet. In one embodiment, this elasticized portion runs along the lip from one side of the mattress to the other side of the mattress and does not extend up to any portion of the bed sheet which would be overlying a side of the mattress. In another embodiment, the elasticized portion runs partially along the lip, mainly at the ends of the lip.

The result of this type of structure is that not only can beds be made up quickly and efficiently with a top bed sheet that is not wrinkled but rather is flat when it lies on the mattress, the lack of elastic material along the side of the mattress permits the bed sheet to be lifted up when the individual is sleeping and his toes protrude up from the mattress.

Thus what is provided is a fitted top bed sheet that makes making up a bed easy while at the same time does not subject the toes of a sleeping individual to undue sheet pressure.

In summary, a fitted top sheet is provided with a lip having an elastic member that runs side to side along at least a portion of the lip. This provides corners that grab the corners of the mattress for a form fit, while at the same time permitting movement of the sheet upwardly to accommodate an individual's toes without having to provide the so-called zone of expansion described in the aforementioned patent.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
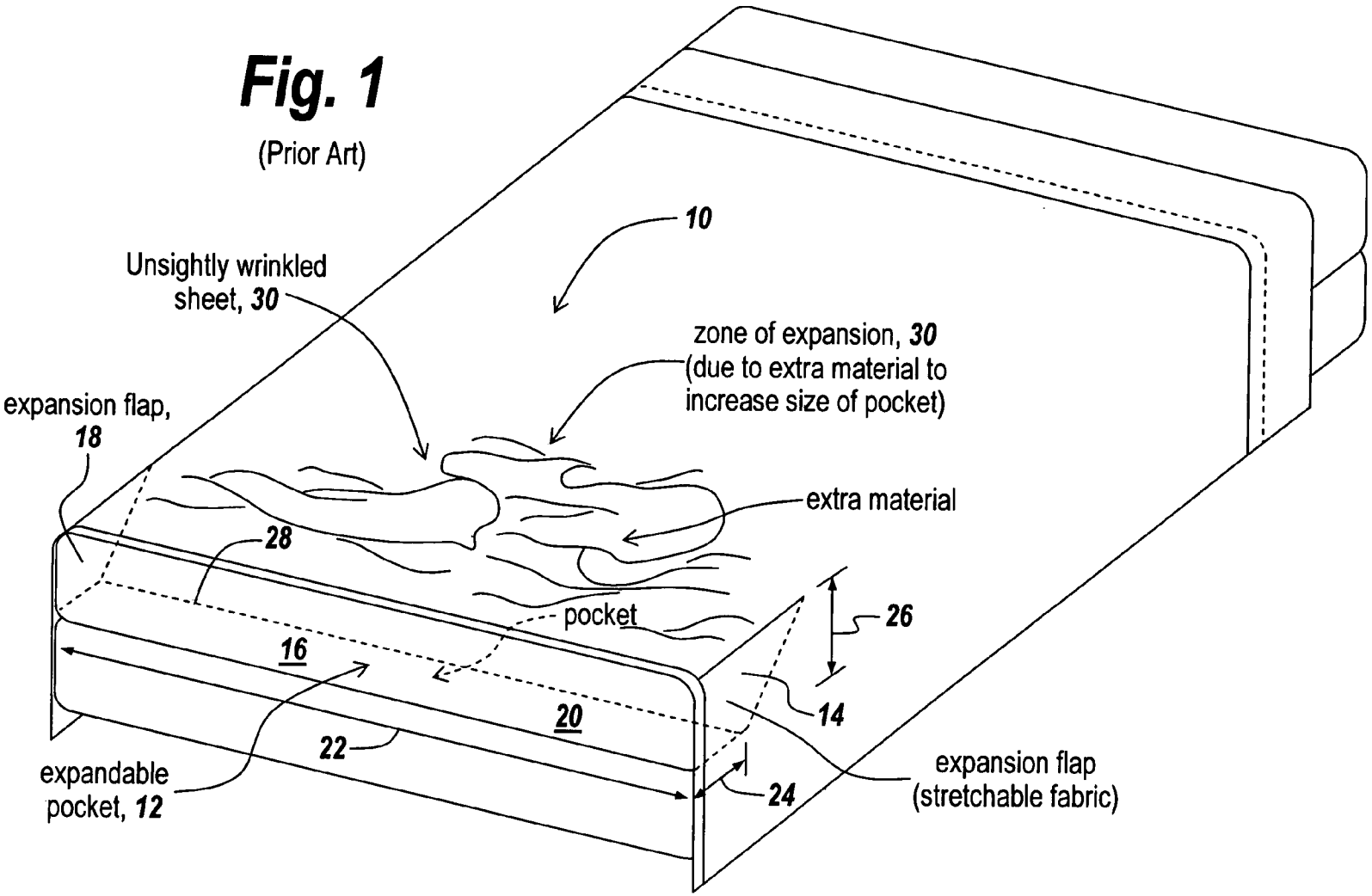
Fig. 1 (Prior Art)
FIG. 1 is a diagrammatic illustration of a prior art bed sheet in which an expandable pocket is formed at the end of the bed sheet and in which a zone of expansion is provided due to the oversized aperture of the pocket, with the oversized aperture providing increased amount of material at the foot of the bed sheet to accommodate the toes of a sleeping individual.

Referring now to FIG. 1, in the prior art a fitted top bed sheet 10 is provided with an expandable pocket 12 which has sidewalls 14, 16 and 18 along with a bottom 20 that completes pocket 12. This is the type of configuration shown in U.S. Pat. No. 7,380,297 where it is said that the size of the pocket here, illustrated by arrows 22, 24 and 26, creates an oversized aperture for the pocket as illustrated at edge 28 shown in dotted outline.

In this patent it is said that it is the purpose of the oversizing to provide a zone of expansion 30 at the base of the top sheet so as to accommodate the toes of a sleeping individual.

However, in such a configuration, the surface of top sheet 10 has an unsightly wrinkled appearance as illustrated at 30 due to the desire to have the aforementioned zone of expansion. This oversized pocket aperture configuration when collapsed upon the end of the mattress creates a wrinkled appearance due to the increase in material involved, and it is for this reason that the commercial viability of the bed sheet has not been demonstrated.

Figure 2A:
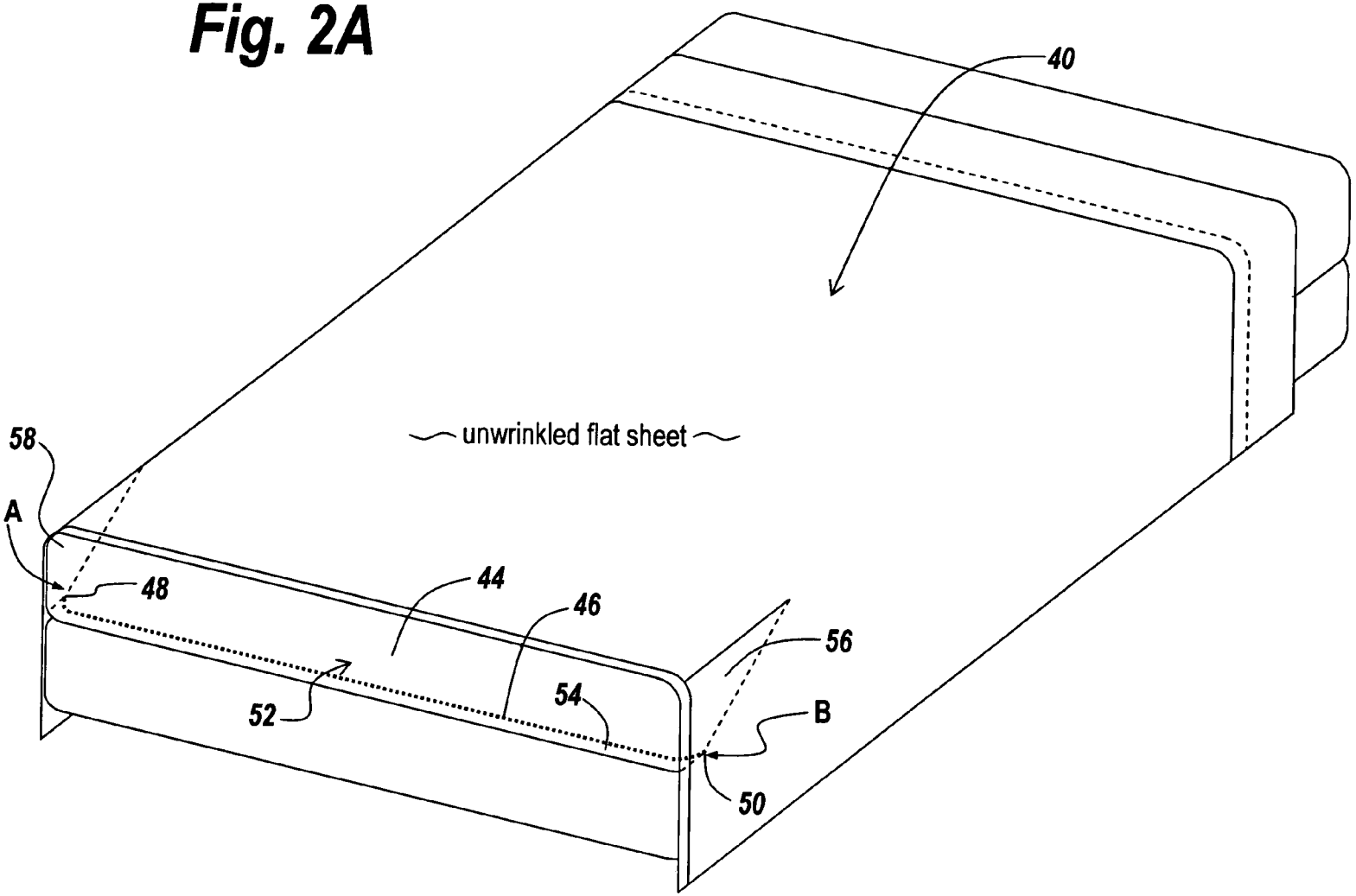
FIGS. 2A and 2B are diagrammatic illustrations of the subject fitted top bed sheet illustrating an unwrinkled flat sheet with the sheet being tucked in by an elastic member that goes along the lip of the sheet, and in which, as shown in FIG. 2B, the sheet is movable upwardly to accommodate a sleeping individuals toes since there is no elastic member on the sides of any bed sheet pocket.

On the other hand and referring to FIG. 2A, a fitted top sheet 40 is provided with a lip or edge 44 to be slipped under a mattress at which is supplied an elastic material 46 that runs laterally from one end, here illustrated at A, to an opposing end B. Here a corner 48 abuts one end of the elastic material and a corner 50 abuts the opposing end. Alternatively, the elastic material runs on only a portion of the lip, mainly at the ends of the lip, i.e. from the lip ends a short distance towards the center of the lip.

The sheet in this case is provided with a material that extends downwardly as illustrated at 52 and moves underneath the mattress laterally as illustrated at 54, with the sheet having side walls 56 and 58.

Figure 2B:
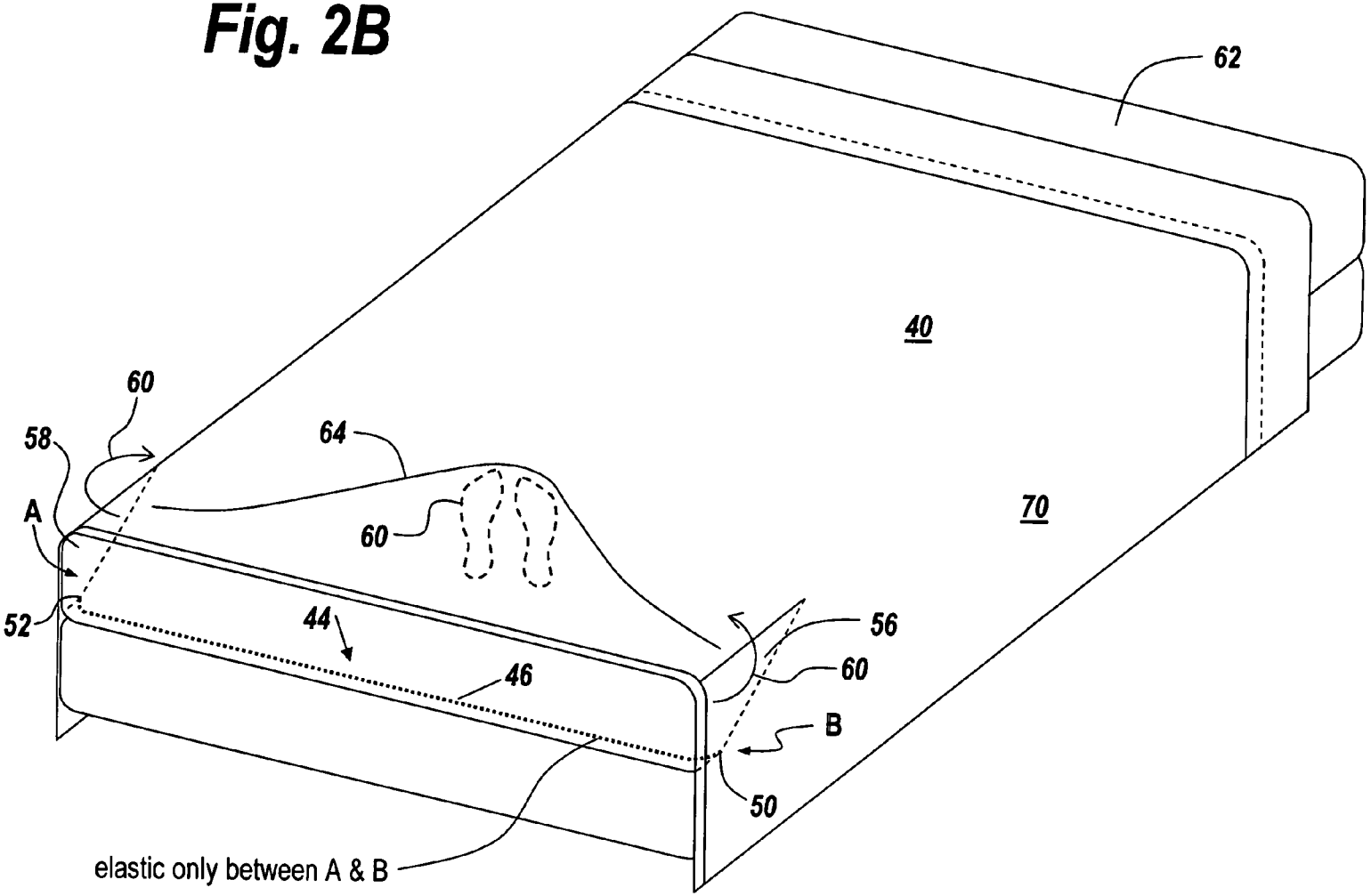

Referring to FIG. 2B, with a sleeping individual's foot 60 on top of mattress 62 top sheet 40 gives upwardly as illustrated at 64, with the movement permitted by the movement illustrated by arrows 60.

It is possible for the bed sheet to move in the direction of arrows 60 because the folded-down portions 70 of the bed sheet are not elastically fastened to anything and can therefore be free to move when an individual's toes push up on the bed sheet.

As will be seen, having elastic only between points A and B does not unduly restrict folded down portions 70 from moving in the direction illustrated.

The net result is that one can achieve a fitted top sheet which is easy to tuck in by virtue of the elasticized lip and which stays in place in one embodiment due to elastic only between the laterally opposed ends of the lip. The result is a smooth appearance prior to the sleeping individual moving between the sheets with the fitted top sheet accommodating the feet of a sleeping individual as described above. Alternatively, only the ends of the lip need be provided with elastic material so as to provide a corner that is held snug to the associated mattress corner.

Figure 3:
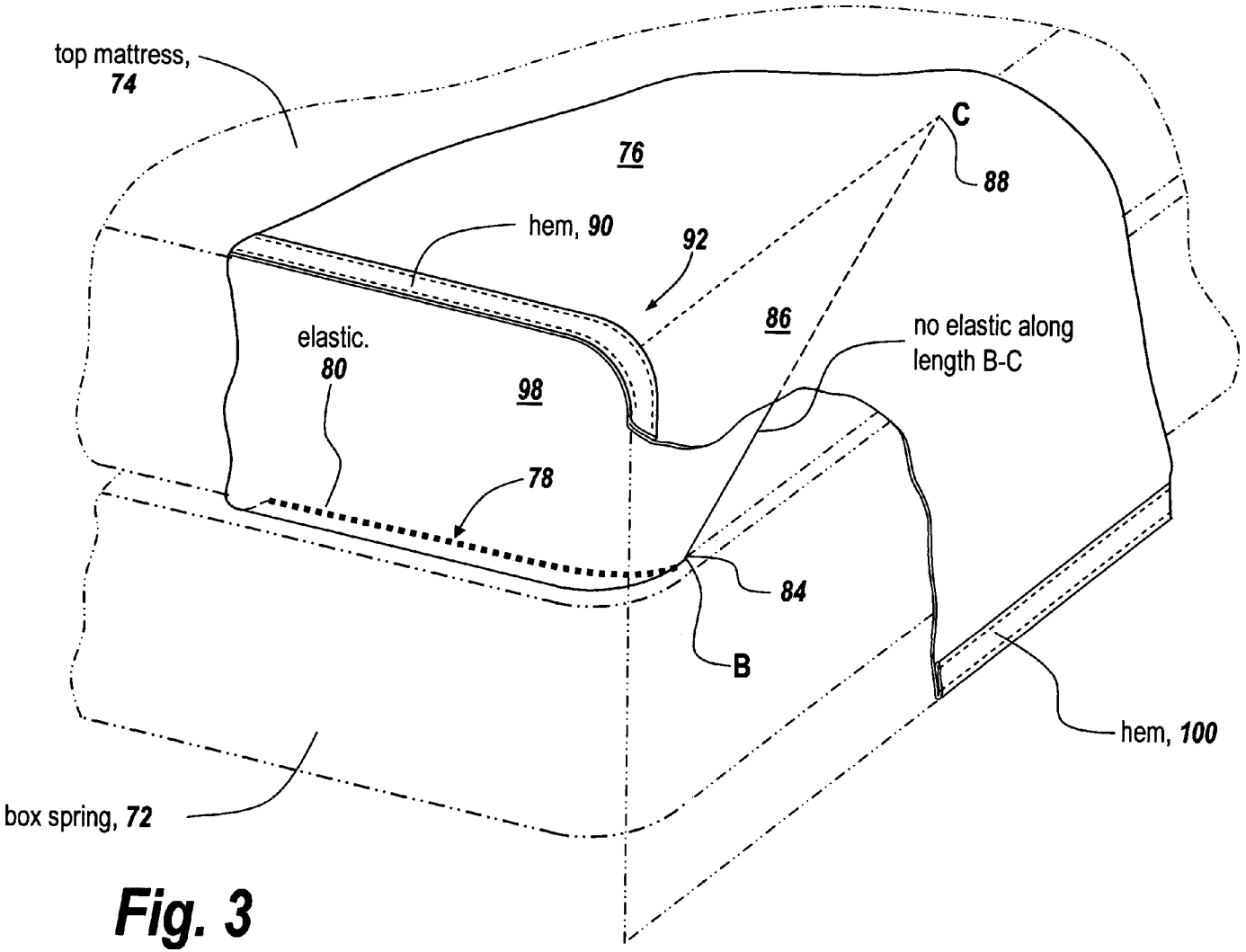
FIG. 3 is a diagrammatic and sectional view of one end of the subject fitted top sheet showing the existence of the elastic member at the lip of the sheet, also showing no elastic along a length from the end of the elastic reinforced lip to the flap at the top of the bed sheet which is designed to overlie the side of a mattress.

Referring now to FIG. 3, what is shown is a box spring 72 on top of which is a mattress 74, with the top bed sheet 76 having the aforementioned lip 78. Also shown is an elastic 80 running along lip 78 where it stops at point B at the corner. Note that there is a portion of material that extends from point 84 on material 86 to point C, here illustrated at 88, with there being no elastic along the length BC.

It is this feature which permits movement of the top bed sheet in response to a sleeping individual inserting his feet between the sheets.

Also illustrated is a hem 90 that joins a flat portion 92 of top bed sheet 76 with a downwardly extending portion 98. Note there is a hem 100 at the distal end of the bed sheet which overhangs the mattress.

Figure 4:
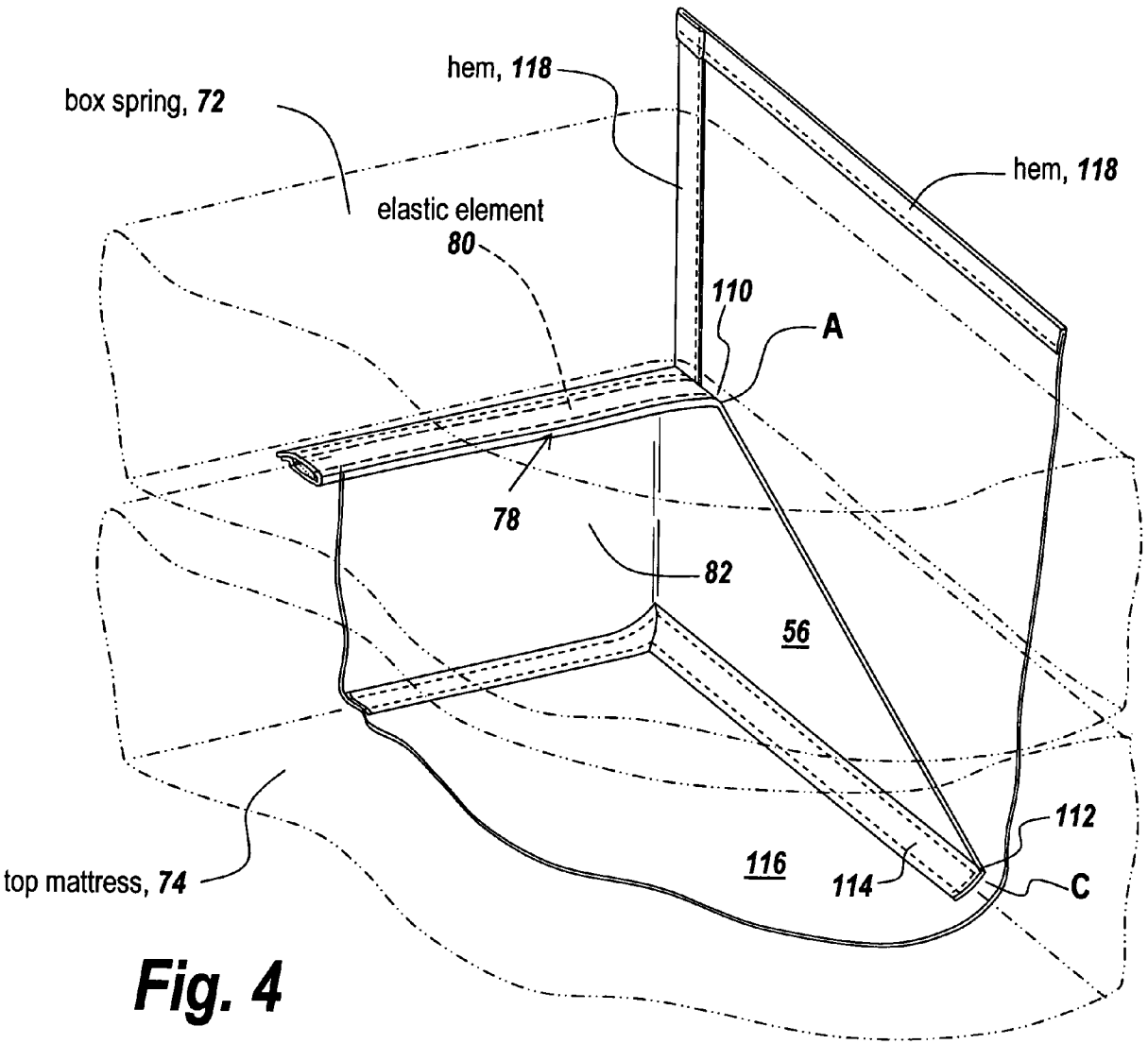
FIG. 4 is a diagrammatic illustration of a portion of the subject top sheet viewed from the top surface of the mattress up towards the box spring, illustrating the fact that there is no elastic provided between the lip end and the point on a flap of the bed sheet which falls down over the mattress.

Referring to FIG. 4, the construction of one corner of the bed sheet is shown in which lip 78 is illustrated by the associated arrow. In this view one is looking from the top surface of mattress 74 upwardly towards box spring 72, with elastic 80 shown running along lip 78. Here it will be seen that corner 110 at point A is joined to a point 112 corresponding to point C, with there being no elastic between point A and point C. As can be seen, stitching 114 connects panel 56 to a top sheet portion 116, with hem 118 being provided around the fold-over portion of the bed sheet that drapes below the mattress.

In summary, a fitted top sheet is provided with a lip having an elastic material to create an elasticized corner adapted to fit over an end of a mattress.

More particularly, a fitted top sheet adapted to be fit over a mattress has a lip at the foot of the sheet. When folded under a mattress, the material at the end of the sheet has an end panel, a pair of opposed side panels and a thin bottom panel, with the bottom panel having a lip that projects slightly under the mattress. The lip carries elastic material, with no other elastic material provided or carried by the sheet. In one embodiment, the top sheet has side panels which are adapted to be folded down, such that upon insertion of an individual's feet between the mattress and the top sheet, the top sheet has enough give to accommodate the individual's feet without undue pressure on the individual's feet due to the unrestrained motion of the side panels. As a result, a bed having been made up with the fitted top sheet does not have a wrinkled appearance. At the same time the subject fitted top sheet provides sufficient give to accommodate an individual's feet beneath the top sheet.

Additionally, a method of avoiding wrinkling of a fitted top sheet starts out with a top sheet provided with a lip at the foot of the top sheet, with only this lip provided with elastic material. The ends of the lip are joined to positions on the underside of the top sheet with non-elastic material such that the sheet has a tight wrinkle-free fit to the mattress and such that there is enough give at the foot of the top sheet to accommodate an individual's feet.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A fitted bed top covering having a foot and a head, said bed top covering adapted to be fit over a mattress and having a lip at the foot of the bed top covering, said bed top covering having an end portion at the foot of said bed top covering, a pair of opposed side portions at the foot of said bed top covering and a thin bottom portion adapted to be slipped under an end of said mattress, said lip having elastic material thereat running at least partially from one side of said lip to the other, with no other elastic material provided or carried by said bed top covering, said bed top covering having portions which are adapted to be folded down over the mattress such that upon insertion of an individual's feet between the mattress and said bed top covering, said bed top covering has enough give to accommodate the individual's feet without undue pressure on the individual's feet, said bed top covering having an underneath side and said lip having opposed ends and having elasticized corners attached, the ends of said lip attached to the underneath side of said bed top covering by material, wherein the points at which the opposed ends of said lip are attached by material to the underside of said bed top covering are not directly above the opposed ends of said lip but are attached to the underside of said bed top covering at points on the underside of said bed top covering towards the head of said bed top covering, whereby a bed having been made up with said fitted bed top covering does not have a wrinkled appearance while at the same time provides sufficient give to accommodate an individual's feet beneath said bed top covering.

2. The apparatus of claim 1, wherein said bed top covering is made from non-flexible material.

3. The apparatus of claim 2, wherein said lip ends are attached to said bed top covering by unelasticized material, and wherein said elasticized material runs inwardly from said lip ends towards the center of said lip.

4. The apparatus of claim 3, wherein said inwardly running elasticized material runs completely from one end of said lip to the other.

5. The apparatus of claim 1, wherein the position of the attachment of the ends of said lip to the underside of said bed top covering is not so far towards the head of said bed top covering so as to preclude motion of said overlying folded down portions of said bed top covering responsive to the pushing upwardly of said bed top covering by an individual's feet.

6. The apparatus of claim 1, and further including a portion of the material of said bed top covering stitched to a portion of said lip to connect said lip to said bed top covering, whereby the material to one side of said lip is stitched to said bed top covering.

7. The apparatus of claim 1, wherein said bed top covering has side portions that fall downwardly when said bed top covering is fit to the mattress.

8. The apparatus of claim 7, wherein at least a major portion of each side portion is free to move upwardly when said fitted bed top covering is in place on a mattress, thus to establish bed top covering give at the foot of said bed top covering when an individual's foot is inserted between said bed top covering and the mattress.

* * * * *